United States Patent [19]

Sloevsky et al.

[11] 3,960,082

[45] June 1, 1976

[54] DOWN-THE-HOLE DEVICE FOR BREAKING ROCK, CONCRETE AND REINFORCED CONCRETE BY PULSEWISE HIGH LIQUID PRESSURE

[76] Inventors: Fedor Ignatievich Sloevsky, ulitsa Cheremushkinskaya, 32 korpus 2, kv. 4, Moscow; Naum Yakovlevich Orlov, ulitsa Klochkovskaya, 276-a, kv. 9, Kharkov; Petr Dmitrievich Gavrish, ulitsa 8 Siezda Sovetov, 7, kv. 38, Kharkov; Anatoly Nikolaevich Rashevsky, ulitsa 23 Avgusta, 20, kv. 26, Kharkov, all of U.S.S.R.

[22] Filed: Jan. 29, 1974

[21] Appl. No.: 437,666

[52] U.S. Cl. ..... 102/22; 102/25; 299/13; 102/21.8

[51] Int. Cl.[2] ..... F42B 3/06

[58] Field of Search ..... 102/21.8, 22, 23, 25; 299/13

[56] References Cited

UNITED STATES PATENTS

| | | | |
|---|---|---|---|
| 1,921,229 | 8/1933 | Hodge | 102/25 |
| 2,034,569 | 3/1936 | Ferrell et al. | 102/25 |
| 2,650,540 | 9/1953 | Bugg | 102/25 |
| 2,916,993 | 12/1959 | Smith et al. | 102/25 |
| 3,031,964 | 5/1962 | Chesnut | 102/21.8 |

*Primary Examiner*—Verlin R. Pendegrass
*Attorney, Agent, or Firm*—Haseltine, Lake & Waters

[57] ABSTRACT

The device has a hollow housing having made therein a chamber adapted to accommodate an explosive charge, separated by a partition made of an elastomeric material for sealing the chamber from the cavity of the housing, communicating with the hole through lateral apertures in the housing. The device further includes a stem of a diameter that is less than that of the rest of the housing, preferably threadedly secured to the bottom face of the housing. The stem has cut therein axial and radial passsages establishing communication between the cavity of the housing and the external lateral surface of the stem. A ring of an elastomeric material is received about the stem so that it closes off the openings of the radial passages in the external lateral surface of the stem. When the charge is exploded, the partition separating the chamber and the cavity is destroyed, and the gases produced by the explosion create a pulse of high pressure in the liquid filling the cavity, which pressure acts through the lateral apertures in the housing upon the walls of the hole, breaking the material. Simultaneously, this high pressure pulse in the liquid acts through the radial and axial passages in the stem upon the elastomeric ring, expanding the latter and pressing it against the wall of the hole, closing the hole and thus retaining the device in the hole.

3 Claims, 1 Drawing Figure

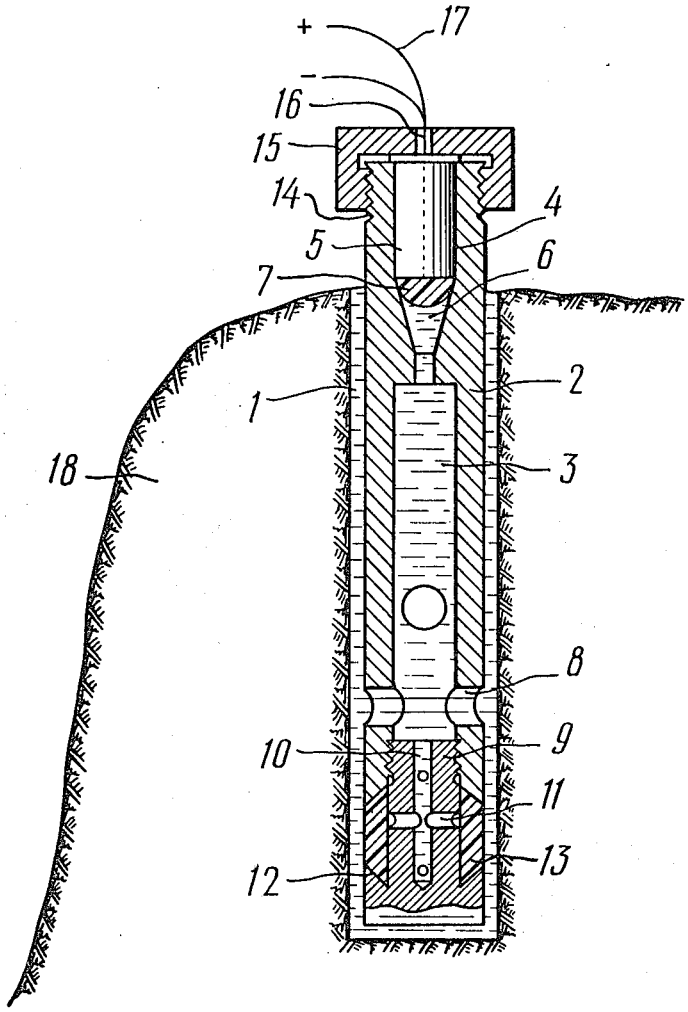
+
17
−
16
15
14
4
5
6
7
2
1
18
3
8
9
10
11
13
12

DOWN-THE-HOLE DEVICE FOR BREAKING ROCK, CONCRETE AND REINFORCED CONCRETE BY PULSEWISE HIGH LIQUID PRESSURE

The present invention relates to down-the-hole devices for breaking hard solid rock, concrete and reinforced concrete structures, which are utilized for excavation of foundation pits for various buildings, for breaking oversize rock in tunneling, in quarry operation, for breaking old concrete and reinforced concrete structures prior to construction of new industrial buildings, etc.

At present, there are utilized for breaking hard solid rock various devices of the so-called hydraulic wedge-type and electrohydraulic breaking devices.

Among the disadvantages common to these known devices are their bulky construction, high cost of manufacture, relatively complicated operation and incapability of independent performance, since these known devices need a supply of electric power for their operation.

There is also known a down-the-hole device for breaking rock, concrete and reinforced concrete by pulsewise high liquid pressure, which device is lowered into a hole pre-drilled in the material to be broken and pre-filled with a liquid. This known device includes a housing with an internal cavity, having lateral apertures through which this internal cavity communicates with the hole, the housing including a closed chamber adapted to accommodate therein a charge of explosive, the chamber being separated from the internal cavity by a sealing partition made of an elastomeric material, the chamber being adapted to communicate with the internal cavity as a result of the explosion of the explosive charge, when the gases produced break the partition and generate pulsewise pressure, exerted by the liquid upon the walls of the hole.

However, this known device has not as yet found practical applications on account of the fact that the pulsewise liquid pressure developed by the device acts simultaneously on the walls of the hole and on the bottom of the device, driving the latter out of the hole.

It is an object of the present invention to create a down-the-hole device for breaking rock, concrete and reinforced concrete by pulsewise high liquid pressure, which is not driven out of the hole by the high pressure pulse it produces.

It is another object of the present invention to create a device which is lightweight, portable and of a high destructive capacity.

It is still another object of the present invention to create a device which is simple both in manufacture and in operation.

It is also an object of the present invention to create a device which is inexpensive.

These and other objects are attained in a device for breaking rock, concrete and reinforced concrete by pulsewise liquid pressure, adapted to be lowered into a hole pre-drilled in the material to be broken and pre-filled with a liquid, the device including a housing with an internal cavity and lateral apertures through which this cavity is adapted to communicate with the hole, the housing having a closed bottom and the upper portion of the housing including a closed chamber adapted to accommodate therein a charge of an explosive. The chamber is separated from the internal cavity by a sealing partition made of an elastomeric material, and being adapted to communicate with the internal cavity of the housing during the explosion, when the gases produced by this explosion break this partition and produce a liquid pressure pulse applied to the walls of the hole.

In accordance with the present invention the lower portion of the housing includes passage means having one end thereof communicating with the internal cavity and the other end thereof open on the external lateral surface of said housing, there being applied about the lower portion of the housing and secured thereon a ring made of an elastomeric material so that this ring closes the openings of the passage means in the external lateral surface of the housing. Thus when the high liquid pressure pulse is generated, this elastomeric ring is pressed by this pulse against the walls of the hole, sealingly closing this hole and retaining the device therein.

It is advisable that the lower portion of the housing, wherein the passage means are made, be in the form of a stem of which the diameter is smaller than the diameter of the rest of the housing, the stem being secured to this housing and having cut in the external lateral surface thereof an annular dovetail groove adapted to have secured therein the elastomeric ring, the passage means extending in this stem in axial and radial directions.

This structure provides for easy replacement of a worn elastomeric ring.

It is further advisable, in order to increase the value of the pulsewise liquid pressure applied to the walls of the hole, that the chamber adapted to accommodate therein the explosive charge communicate with the internal cavity of the housing via a passage tapering toward this cavity.

This tapered passage has been found to increase the rate of flow of the liquid and thus to step up the pulsewise liquid pressure applied to the walls of the hole.

According to the present invention there is provided a device for breaking rock, concrete and reinforced concrete by pulsewise high liquid pressure, ensuring that the device is retained in the hole when this high pulsewise liquid pressure is applied to the walls of the hole, the device being lightweight and portable, of a high destructive capacity, inexpensive and simple in manufacture and operation.

The present invention will be described hereinbelow in connection with an exemplary embodiment thereof, with reference being had to the accompanying drawing, the sole FIGURE of which shows a longitudinally sectional view of a down-the-hole device for breaking rock, concrete and reinforced concrete by pulsewise high liquid pressure, constructed in accordance with the present invention.

The device, which has been lowered in a hole 1 pre-drilled in the material 18 to be broken and pre-filled with a liquid comprises a housing 2 having made therein an internal cavity 3 adapted to be filled with the liquid and a chamber 4 adapted to accommodate therein an explosive charge 5, e.g. gunpowder charge. The cavity 3 and the chamber 4 communicate via a tapered passage 6 narrowing toward the cavity 3. A partition 7 made of an elastomeric material sealingly closes the inlet of the passage 6. Apertures 8 are cut through the wall of the housing 2 of the device to provide for outflow of the liquid under pressure from the cavity 3.

The lower portion of the housing 2 has threadedly secured to the end face thereof a stem 9 having cut therein an axial passage 10 ending short of the bottom of the stem 10 and radial passages 11 open on the external lateral surface of the stem. The lateral external surface of the stem 9 has cut therein an annular dovetail groove 12 in which there is secured a ring 13 made of an elastomeric material, the ring 13 closing the outlets of the through radial passages 11.

The elastomeric ring 13 is adapted to be expanded when a pressure pulse is created in the cavity 3 by explosion of the charge 5, and pressed against the wall of the hole 1, sealingly closing this hole and thus preventing action of the liquid pressure upon the bottom face of the device.

To facilitate positioning of the device in the hole and to prolong the life of the ring 13, the external diameter of the latter is preferably 1–2 mm smaller than the diameter of the hole.

Threaded onto the thread 14 cut in the upper portion of the housing 2 is a nut 15 provided with an apperture 16 through which extend wires 17 having one end thereof connected to the explosive charge 5, the other ends of the wires being connectable, to initiate the explosion, to a source of electric power (not shown). This source may be in the form of a battery, e.g. a storage battery, an exploder, etc. The device operates as follows. A hole is drilled in the material 18 to be broken and is filled with a liquid, whereafter the inventive device is lowered into the hole, for the liquid to fill the internal cavity 3 through the apertures 8.

When the charge 5 is exploded, the gases produced by the explosion press down the elastomeric partition 7 into the cavity 3, whereby liquid pressure is rapidly built up in the latter, and the liquid acts through the apertures 8 upon the walls of the hole 1, breaking the material 18.

Simultaneously the high liquid pressure acts via the passages 10 and 11 upon the ring 13, the passages being situated below the lateral apertures 8 expanding the ring and pressing it against the wall of the hole 1, preventing transmission of the high pressure of the liquid to the bottom face of the device and thus preventing the device from being forced out of the hole.

Alternatively, the charge 5 may be exploded by a striker pin mechanism which is threaded onto the housing 2 instead of the nut 15.

The herein disclosed device is capable of breaking rock of any hardness, as well as concrete and reinforced concrete.

The device is safe in operation and makes unnecessary any transfer of personnel and equipment from the working site; neither does it call for interrupting the process of construction or production.

The device is simple both in manufacture and in operation; it is lightweight and independent, since it does not need an external power source for its operation.

The industrial use of the herein disclosed device offers substantial costs reduction.

We claim:

1. A down-the-hole device for breaking materials such as rock, concrete and reinforced concrete by pulsewise high liquid pressure, adapted to be lowered into a hole pre-drilled in the materials to be broken and pre-filled with a liquid, the device comprising: a hollow housing having a closed bottom; a closed chamber within the upper portion of said housing, to accommodate an explosive charge; a cavity defined within said housing below said chamber, communicating via lateral apertures made through the wall of said housing with the hole so that part of the liquid in the latter fills up said cavity when the device has been lowered into the hole; means for initiating the exposion of the charge; a partition made of an elastomeric material and sealingly positioned in said housing between said chamber and said cavity, first, to separate them prior to the explosion of the charge and, second, to establish communication therebetween after the explosion, resulting in destruction of said partition for gases produced by the explosion, to create a high-pressure pulse in the liquid in said cavity and for the liquid to act through said apertures upon the walls of the hole so as to break the materials; small-diameter passage means provided in the lower portion of said housing with openings therein, and having one end thereof communicating with said cavity and the other end thereof open on the external lateral surface of said housing; and a ring also made of an elastomeric material, received and secured about said lower housing portion below said apertures so that said ring closes off said openings of the passage means in said external laterial surface of the housing; said ring being expanded during the explosion of the charge by the high-pressure pulse and pressed thereby against the walls of the hole, below the destruction region, to sealingly close the hole and to retain the device therein.

2. The device as defined in claim 1, wherein said lower housing portion includes a stem of a diameter that is smaller than the diameter of the rest of said housing, said stem having an annular dovetail groove cut in said external lateral surface, for securing said ring therein, said passage means being cut in said stem and extending therein in axial and radial directions below said apertures.

3. The device as defined in claim 1, wherein said chamber communicates with said cavity via a passage tapering toward said cavity, in order to increase the pressure of the liquid upon the walls of the hole.

* * * * *